US005800158A

United States Patent [19]

De Groot

[11] Patent Number: 5,800,158

[45] Date of Patent: Sep. 1, 1998

[54] OUTDOOR OPEN FIRE IGNITER

[76] Inventor: Victor H. De Groot, 827 24 Avenue NW, Calgary, Alberta, Canada, T2M 1X9

[21] Appl. No.: 771,487

[22] Filed: Dec. 23, 1996

[51] Int. Cl.[6] ..... F23D 14/20; F23D 14/28; F23D 14/46

[52] U.S. Cl. ..... 431/343; 431/345; 126/25 B; 239/530

[58] Field of Search ..... 126/25 B; 431/354, 431/343, 345; 248/81, 82, 83, 107, 79, 105, 117.1, 117.2, 117.3, 117.4, 117.5, 117.6, 117.7; 239/525, 530

[56] References Cited

U.S. PATENT DOCUMENTS

| | | | |
|---|---|---|---|
| 304,151 | 8/1884 | White . | |
| 793,894 | 7/1905 | Mitchell | 126/414 |
| 835,017 | 11/1906 | Eversole | 126/414 |
| 959,947 | 5/1910 | Koenig | 126/414 |
| 1,464,497 | 8/1923 | Carnelli | 126/413 |
| 1,492,508 | 4/1924 | Brandrup | 126/414 |
| 1,827,697 | 10/1931 | Anderson | 431/345 |
| 3,219,025 | 11/1965 | Webster | 126/92 B |
| 3,424,385 | 1/1969 | Glutermann et al. . | |
| 3,471,246 | 10/1969 | Piffath et al. . | |
| 4,133,301 | 1/1979 | Fujiwara | 431/344 |
| 4,188,192 | 2/1980 | Levenson et al. . | |
| 4,348,172 | 9/1982 | Miller | 431/255 |
| 4,923,394 | 5/1990 | Fumino | 431/345 |
| 5,135,390 | 8/1992 | Rodriguez | 431/344 |
| 5,143,045 | 9/1992 | Minnis | 126/25 B |

FOREIGN PATENT DOCUMENTS

| | | | |
|---|---|---|---|
| 26505 | 11/1911 | United Kingdom | 124/414 |
| 5724 | 3/1913 | United Kingdom | 239/530 |

*Primary Examiner*—Carl D. Price

[57] ABSTRACT

A new Outdoor Open Fire Igniter for igniting outdoor fires, such as campfires, without conventional kindling required whether the wood is wet or dry. The inventive device includes an elongated hose secured to a portable gas tank, a control valve secured to the elongated hose opposite of the portable gas tank, a gas tube secured to the control valve, an elongated outer tube with a plurality of radially positioned gas aperture secured to the control valve surrounding the gas tube, and a support stand removably coupling to the elongated outer tube.

5 Claims, 3 Drawing Sheets

OUTDOOR OPEN FIRE IGNITER

BACKGROUND OF THE INVENTION

1. Field of the Invention

The present invention relates to Igniting Devices and more particularly pertains to a new Outdoor Open Fire Igniter for igniting outdoor fires, such as campfires, without conventional kindling required whether the wood is wet or dry.

2. Description of the Prior Art

The use of Igniting Devices is known in the prior art. More specifically, Igniting Devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art Igniting Devices include U.S. Pat. No. 4,348,172; U.S. Pat. No. 5,135,390; U.S. Design Pat. No. 304,151; U.S. Pat. No. 5,143,045; U.S. Pat. No. 4,188,192; U.S. Pat. No. 3,424,385 and U.S. Pat. No. 3,471,246.

While these devices fulfill their respective, particular objectives and requirements, the aforementioned patents do not disclose a new Outdoor Open Fire Igniter. The inventive device includes an elongated hose secured to a portable gas tank, a control valve secured to the elongated hose opposite of the portable gas tank, a gas tube secured to the control valve, an elongated outer tube with a plurality of radially positioned gas aperture secured to the control valve surrounding the gas tube, and a support stand removably coupling to the elongated outer tube.

In these respects, the Outdoor Open Fire Igniter according to the present invention substantially departs from the conventional concepts and designs of the prior art, and in so doing provides an apparatus primarily developed for the purpose of igniting outdoor fires, such as campfires, without conventional kindling required whether the wood is wet or dry.

SUMMARY OF THE INVENTION

In view of the foregoing disadvantages inherent in the known types of Igniting Devices now present in the prior art, the present invention provides a new Outdoor Open Fire Igniter construction wherein the same can be utilized for igniting outdoor fires, such as campfires, without conventional kindling required whether the wood is wet or dry.

The general purpose of the present invention, which will be described subsequently in greater detail, is to provide a new Outdoor Open Fire Igniter apparatus and method which has many of the advantages of the Igniting Devices mentioned heretofore and many novel features that result in a new Outdoor Open Fire Igniter which is not anticipated, rendered obvious, suggested, or even implied by any of the prior art Igniting Devices, either alone or in any combination thereof.

To attain this, the present invention generally comprises an elongated hose secured to a portable gas tank, a control valve secured to the elongated hose opposite of the portable gas tank, a gas tube secured to the control valve, an elongated outer tube with a plurality of radially positioned gas aperture secured to the control valve surrounding the gas tube, and a support stand removably coupling to the elongated outer tube.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Outdoor Open Fire Igniter apparatus and method which has many of the advantages of the Igniting Devices mentioned heretofore and many novel features that result in a new Outdoor Open Fire Igniter which is not anticipated, rendered obvious, suggested, or even implied by any of the prior art Igniting Devices, either alone or in any combination thereof.

It is another object of the present invention to provide a new Outdoor Open Fire Igniter which may be easily and efficiently manufactured and marketed.

It is a further object of the present invention to provide a new Outdoor Open Fire Igniter which is of a durable and reliable construction.

An even further object of the present invention is to provide a new Outdoor Open Fire Igniter which is susceptible of a low cost of manufacture with regard to both materials and labor, and which accordingly is then susceptible of low prices of sale to the consuming public, thereby making such Outdoor Open Fire Igniter economically available to the buying public.

Still yet another object of the present invention is to provide a new Outdoor Open Fire Igniter which provides in the apparatuses and methods of the prior art some of the advantages thereof, while simultaneously overcoming some of the disadvantages normally associated therewith.

Still another object of the present invention is to provide a new Outdoor Open Fire Igniter for igniting outdoor fires, such as campfires, without conventional kindling required whether the wood is wet or dry.

Yet another object of the present invention is to provide a new Outdoor Open Fire Igniter which includes an elongated hose secured to a portable gas tank, a control valve secured to the elongated hose opposite of the portable gas tank, a gas tube secured to the control valve, an elongated outer tube with a plurality of radially positioned gas aperture secured to the control valve surrounding the gas tube, and a support stand removably coupling to the elongated outer tube.

Still yet another object of the present invention is to provide a new Outdoor Open Fire Igniter that can be positioned into a fire pit containing fire wood, whether dry or wet.

Even still another object of the present invention is to provide a new Outdoor Open Fire Igniter that easily ignites wet firewood without kindling.

These together with other objects of the invention, along with the various features of novelty which characterize the invention, are pointed out with particularity in the claims annexed to and forming a part of this disclosure, For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
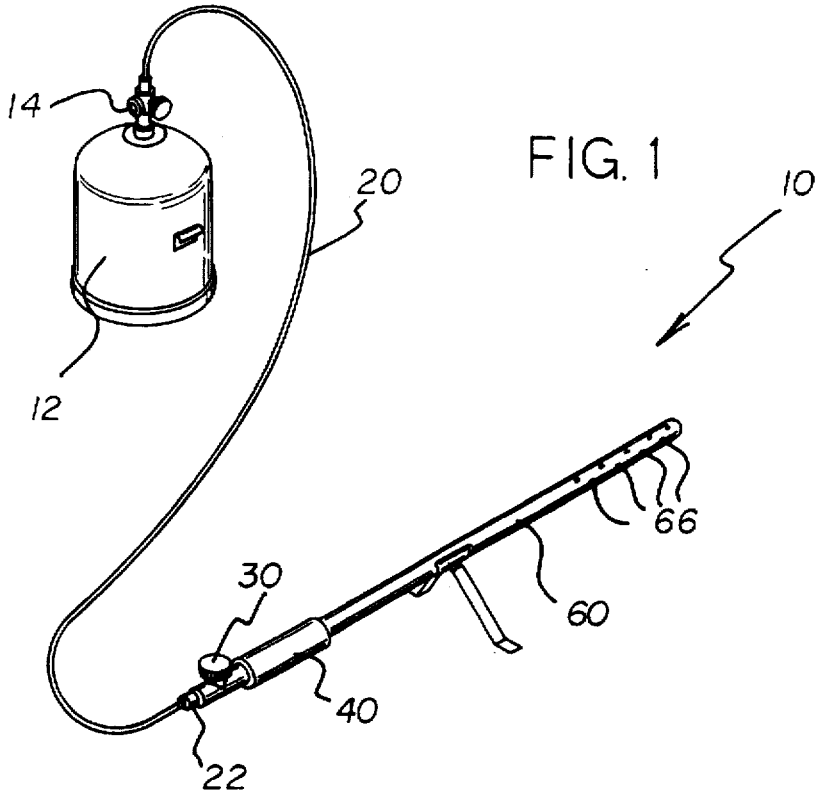
FIG. 1 is an upper side perspective view of a new Outdoor Open Fire Igniter according to the present invention.

With reference now to the drawings, and in particular to FIGS. 1 through 6 thereof, a new Outdoor Open Fire Igniter embodying the principles and concepts of the present invention and generally designated by the reference numeral 10 will be described.

Figure 2:
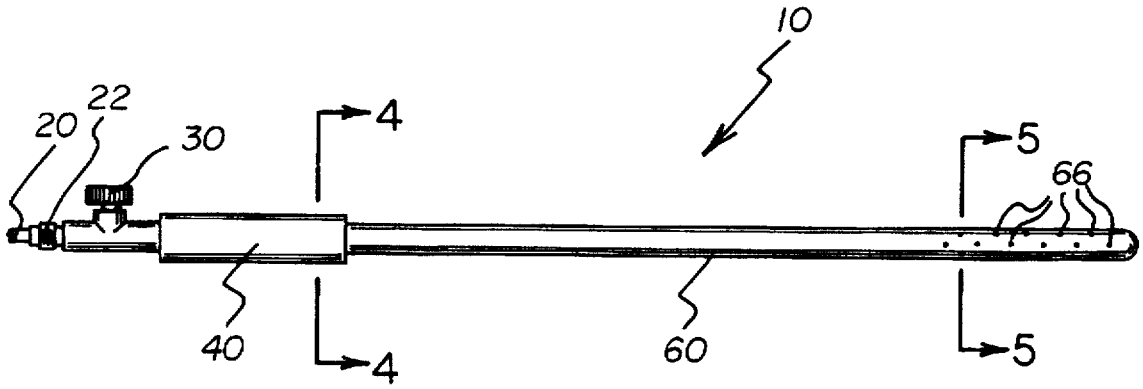
FIG. 2 is a side view of the present invention.

More specifically, it will be noted that the Outdoor Open Fire Igniter 10 comprises a control valve 30, a gas tube 50, and an elongated outer tube 60. The control valve 30 is removably coupled to an elongated hose 20 as best shown in FIG. 1 of the drawings. The elongated hose 20 is coupled to a portable gas tank 12 which supplies the gas. The gas tube 50 is connected to the control valve 30 and extends a finite distance. The elongated outer tube 60 is secured to the control valve 30 and surrounds the gas tube 50 as best disclosed in FIG. 3 of the drawings. The elongated outer tube 60 has a closed end opposite of the control valve 30 as shown in FIG. 2 of the drawings. The elongated outer tube 60 has an inner flange 64 surrounding the gas tube 50 forming a first compartment and a second compartment. The second compartment is enclosed by the closed end. At least one ventilation aperture 62 is positioned within the elongated outer tube 60 projecting into the first compartment as disclosed in FIG. 3 of the drawings. A plurality of gas apertures 66 radially project near the end of the elongated outer tube 60 opposite of the control valve 30 and project into the second compartment as best shown in FIGS. 1 and 2.

Figure 3:
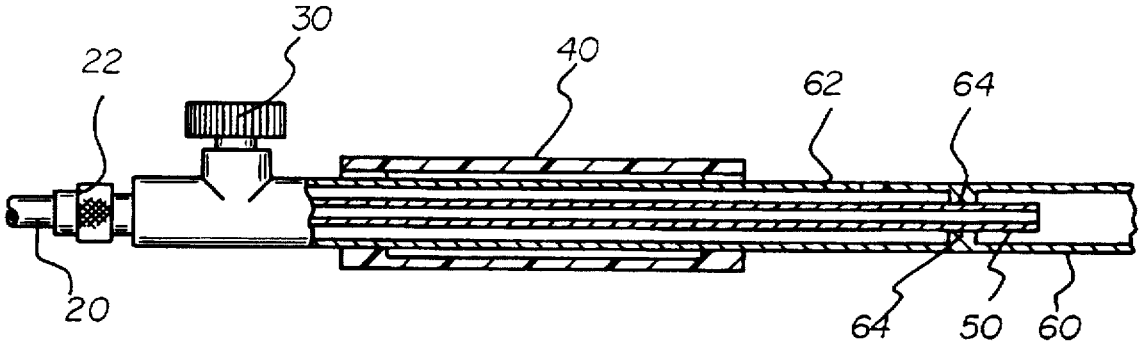
FIG. 3 is a side cut away view of the present invention.
Figure 4:
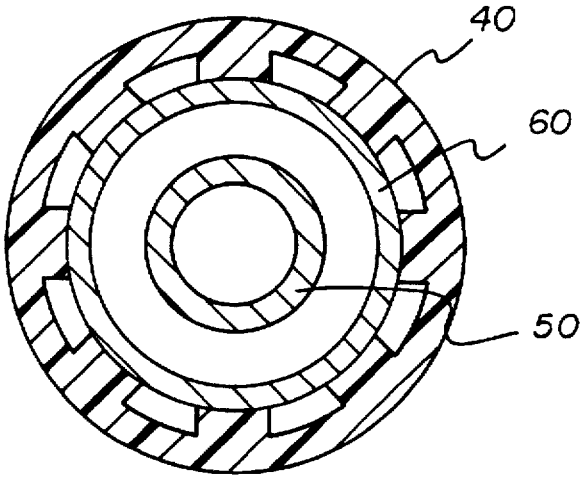
FIG. 4 is a cross sectional view taken along line 4—4 of FIG. 2.
Figure 5:
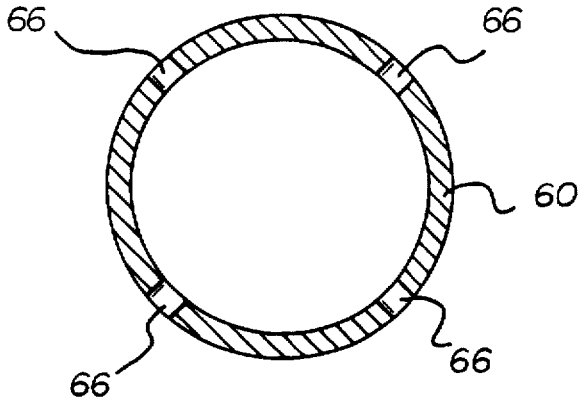
FIG. 5 is a cross sectional view taken along line 5—5 of FIG. 2.
Figure 6:
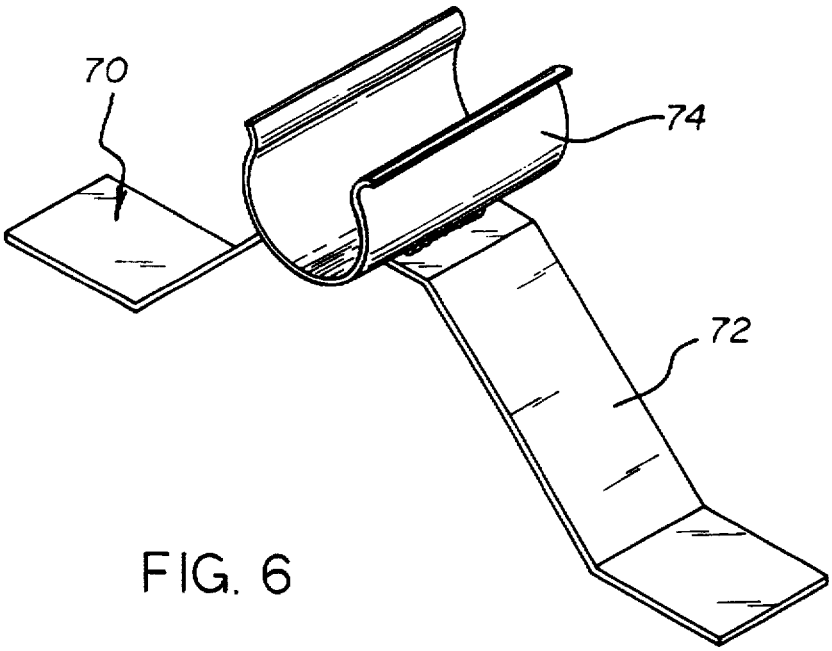
FIG. 6 is an upper perspective view of the support stand.

As best shown in FIGS. 1 through 3 of the drawings, a fire resistant handle 40 is secured around the elongated outer tube 60 near the control valve 30. As shown in FIGS. 1 and 6, a support stand 70 removably couples to the elongated outer tube 60 providing support during operation. The support stand 70 has a syncline leg 72 inverted with respect to the ground, and a snapping clamp 74 secured to the tip of the syncline leg 72. The snapping clamp 74 is removably coupled to the elongated outer tube 60.

In use, the user opens a regulator and valve 14 on the portable gas tank 12. The user then opens the control valve 30 thereby allowing the gas within the portable gas tank 12 to flow through the gas tube 50 into the elongated outer tube 60 then out the gas apertures 66. The user then ignites the gas radiating out of the gas apertures 66. The flame projects radially about the longitudinal axis of the elongated outer tube 60. The elongated outer tube 60 is thereafter inserted into the lower portion of a pile of firewood to act as kindling. After the firewood is dried out enough to ignite and does ignite, the elongated outer tube 60 is removed from the firewood. The regulator and valve 14 are closed and then the control valve 30 is closed thereby positioning the present invention into the storage position until later utilization is required.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. An outdoor open fire igniter, comprising:

a control valve removably coupled to an elongated hose, where said elongated hose is coupled to a portable gas tank;

a gas tube connected to said control valve and extending a finite distance;

an elongated outer tube secured to said control valve and surrounding said gas tube;

said elongated outer tube having a closed end opposite of said control valve;

said elongated outer tube having an inner flange surrounding said gas tube forming a first compartment and a second compartment, where said second compartment is enclosed by said closed end;

said gas tube extending into said second compartment; and a plurality of gas apertures radially projecting near the end of said elongated outer tube opposite of said control valve and projecting into said second compartment;

wherein a fire retardant handle is secured around said elongated outer tube near said control valve;

wherein a support stand removably couples to said elongated outer tube providing support during operation;

wherein said support stand includes;

a syncline leg inverted with respect to the ground; and a snapping clamp secured to the tip of said syncline leg, where said snapping clamp removably couples to said elongated outer tube.

2. An outdoor open fire igniter comprising:

a portable gas storage tank;

a gas delivery means for transporting gas from said gas storage tank into a rigid gas tube, said gas tube structured to have an opening;

a means for regulating gas flow from said gas storage tank into said gas tube;

an outer tube substantially enclosing said gas tube, said outer tube having a substantially sealed distal outer tube end;

said outer tube further having an interior flange positioned to form a compartment defined by said interior flange, said outer tube end, said gas tube, and said outer tube;

said gas tube extending into said compartment such that said gas tube opening is positioned within said compartment; and said outer tube further structured to have a plurality of apertures positioned proximate to said compartment;

a fire retardant handle surrounding said outer tube and positioned opposite said sealed outer tube end;

a syncline leg inverted with respect to the ground; and a snapping clamp secured to the tip of said syncline leg, where said snapping clamp removably couples to said outer tube.

3. An outdoor open fire igniter as in claim 2 wherein said gas delivery means includes a flexible hose removably engageable to said gas tank and said means for regulating gas flow.

4. An outdoor open fire igniter comprising:

a portable gas storage tank;

a gas delivery means for transporting gas from said gas storage tank into a rigid gas tube, said gas tube structured to have an opening;

a means for regulating gas flow from said gas storage tank into said gas tube;

an outer tube substantially enclosing said gas tube said outer tube, having a substantially sealed distal outer tube end;

said outer tube further having an interior flange positioned to form a compartment defined by said interior flange, said outer tube end, said gas tube, and said outer tube;

said outer tube further structured to have a plurality of apertures positioned radially and proximate to said compartment; and said gas tube extending into said compartment such that gas is introduced into said compartment and dispersed radially through the apertures in the outer tube;

a fire retardant handle surrounding said outer tube and positioned opposite said sealed outer tube end;

a syncline leg inverted with respect to the ground; and a snapping clamp secured to the tip of said syncline leg, where said snapping clamp removably couples to said outer tube.

5. An outdoor open fire igniter as in claim 4 wherein said gas delivery means includes a flexible hose removably engageable to said gas tank and said means for regulating gas flow.

* * * * *